US008123421B2

(12) United States Patent
Izuchi

(10) Patent No.: US 8,123,421 B2
(45) Date of Patent: Feb. 28, 2012

(54) MEDIUM FEEDING DEVICE WITH ROLLER CLEANING MEMBER UNDER SHEET TRAY

(75) Inventor: Masatoshi Izuchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 875 days.

(21) Appl. No.: 12/163,979

(22) Filed: Jun. 27, 2008

(65) Prior Publication Data

US 2009/0001647 A1 Jan. 1, 2009

(30) Foreign Application Priority Data

Jun. 27, 2007 (JP) ..... 2007-169397

(51) Int. Cl.
*B41J 3/60* (2006.01)
*B65H 3/06* (2006.01)

(52) U.S. Cl. ..... 400/629; 400/624

(58) Field of Classification Search ..... 400/624, 400/629; 399/393
See application file for complete search history.

(56) References Cited

U.S. PATENT DOCUMENTS 5,284,334 A * 2/1994 Yamamoto ..... 271/107

FOREIGN PATENT DOCUMENTS

| | | | |
|---|---|---|---|
| JP | 58082931 A | * | 5/1983 |
| JP | H05-092641 A | | 4/1993 |
| JP | 07089192 A | * | 4/1995 |
| JP | 11209008 A | * | 8/1999 |
| JP | 2001315983 A | * | 11/2001 |
| JP | 2002193466 A | * | 7/2002 |
| JP | 2006008360 A | * | 1/2006 |

* cited by examiner

*Primary Examiner* — Daniel J Colilla
(74) *Attorney, Agent, or Firm* — Baker Botts L.L.P.

(57) ABSTRACT

According to one aspect of the invention, there is provided a medium feeding device capable of feeding a recording medium placed on a first tray. The medium conveying device includes: a frame having a first surface and allowing the first tray to be movable along the first surface, the first tray being attached to the medium feeding device at a first position of the first surface; a feeding member configured to feed the recording medium to a first conveying path when the first tray with the recording medium thereon is positioned at the first position, a cleaning member disposed at the first surface of the frame and configured to clean the feeding member when the cleaning member is uncovered by the first tray.

12 Claims, 10 Drawing Sheets

MEDIUM FEEDING DEVICE WITH ROLLER CLEANING MEMBER UNDER SHEET TRAY

CROSS-REFERENCE TO RELATED APPLICATIONS

This application is based upon and claims the benefit of priority from Japanese Patent Application No. 2007-169397, filed on Jun. 27, 2007, the entire contents of which are incorporated herein by reference.

TECHNICAL FIELD

One aspect of the present invention relates to an image recording apparatus capable of conveying a recording medium such as recording sheet placed on a tray and recording an image on the sheet in the course of conveying the sheet. Another aspect of the invention relates to a medium feeding device capable of feeding a recording medium.

BACKGROUND

A related-art image recording apparatus may include a roller which is brought into pressing contact with a recording sheet placed on a tray and the roller is driven in the press-contact state. Accordingly, the recording sheet is fed from the tray to a conveying path. Ink or toner is attached to the recording sheet in the course of conveying the recording sheet through the conveying path to form a desired image. As described above, since the roller is pivotally driven in the press-contact state, paper dust or dust on the recording sheet may adhere to the roller. The paper dust or the dust adhering to the roller may cause a jam or a feed failure of the recording sheet. JP-A-5-92641 discloses a cleaning sheet of a feeding roller of a printer for cleaning the roller.

The printer described in JP-A-5-92641 includes a cleaning sheet that can be freely attached to and detached from a tray. In the cleaning sheet, a hook and a sponge cleaning cloth are disposed on a base sheet. The cleaning sheet is fixed to the tray by the use of the hook. The tray is fitted into the printer body in a state where the cleaning sheet is fixed to the tray and no recording sheet is placed on the tray. Accordingly, the roller contacts with the cleaning cloth. When a sheet feed button is pushed in this state, the roller is rotationally driven and the surface of the roller is cleaned by the cleaning cloth.

However, in the printer of JP-A-5-92641, before the cleaning of the roller, the user is required to remove sheets such as recording sheets from the tray, attach the cleaning sheet to the tray, and fit the tray into the printer. Similarly, after the cleaning of the roller, the user is required to separate the cleaning sheet from the tray, return the removed sheets into the tray, and then fit the tray into the printer. In the printer, a user needs to perform such trouble operations before and after cleaning the roller.

In addition, it is necessary to prepare the cleaning sheet depending on the shape of the tray and the arrangement of the roller. Accordingly, the entire configuration of the printer is complicated, thereby increasing the cost of the printer.

SUMMARY

One aspect of the present invention is conceived in view of the above-mentioned circumstances. An object of one aspect of the invention is to provide an image recording apparatus and a medium feeding device that can clean a feeding member such as a roller with a simple configuration without troublesome operations of installing a cleaning member or separating and retaining the cleaning member.

According to a first aspect of the invention, there is provided an image recording apparatus comprising: a main body; a first tray attachable to and capable of being drawn out of the main body, the first tray allowing a sheet to be placed thereon; a first conveying path through which the sheet fed from the first tray is conveyed; a roller that is brought into pressing contact with the sheet placed on the first tray and configured to feed the sheet to the first conveying path; a recording unit configured to record an image on the sheet in a course of conveying the sheet; a frame configured to support the first tray from a downside; and a cleaning member disposed at the frame and configured to clean the roller, wherein the roller is movable relative to the cleaning member, the roller being movable between a first posture in which the roller is supported from the downside by the first tray in a state where the first tray is inserted into the main body and a second posture in which the roller is brought into pressing contact with the cleaning member by drawing out the first tray from the main body to a predetermined position.

According to a second aspect of the invention, there is provided a medium feeding device capable of feeding a recording medium placed on a first tray, the medium conveying device comprising: a frame having a first surface and allowing the first tray to be movable along the first surface, the first tray being attached to the medium feeding device at a first position of the first surface; a feeding member configured to feed the recording medium to a first conveying path when the first tray with the recording medium thereon is positioned at the first position, a cleaning member disposed at the first surface of the frame and configured to clean the feeding member when the cleaning member is uncovered by the first tray.

DESCRIPTION

Hereinafter, exemplary embodiments of the invention will be described with reference to the accompanying drawings. The embodiments of the invention are only examples of the invention and can be properly modified without departing from the scope of the invention.

At first, a configuration and an operation of a multi function device 10 as an example of an image recording apparatus according to an embodiment of the invention will be described.

<Configuration of Multi Function Device 10>

Figure 1:
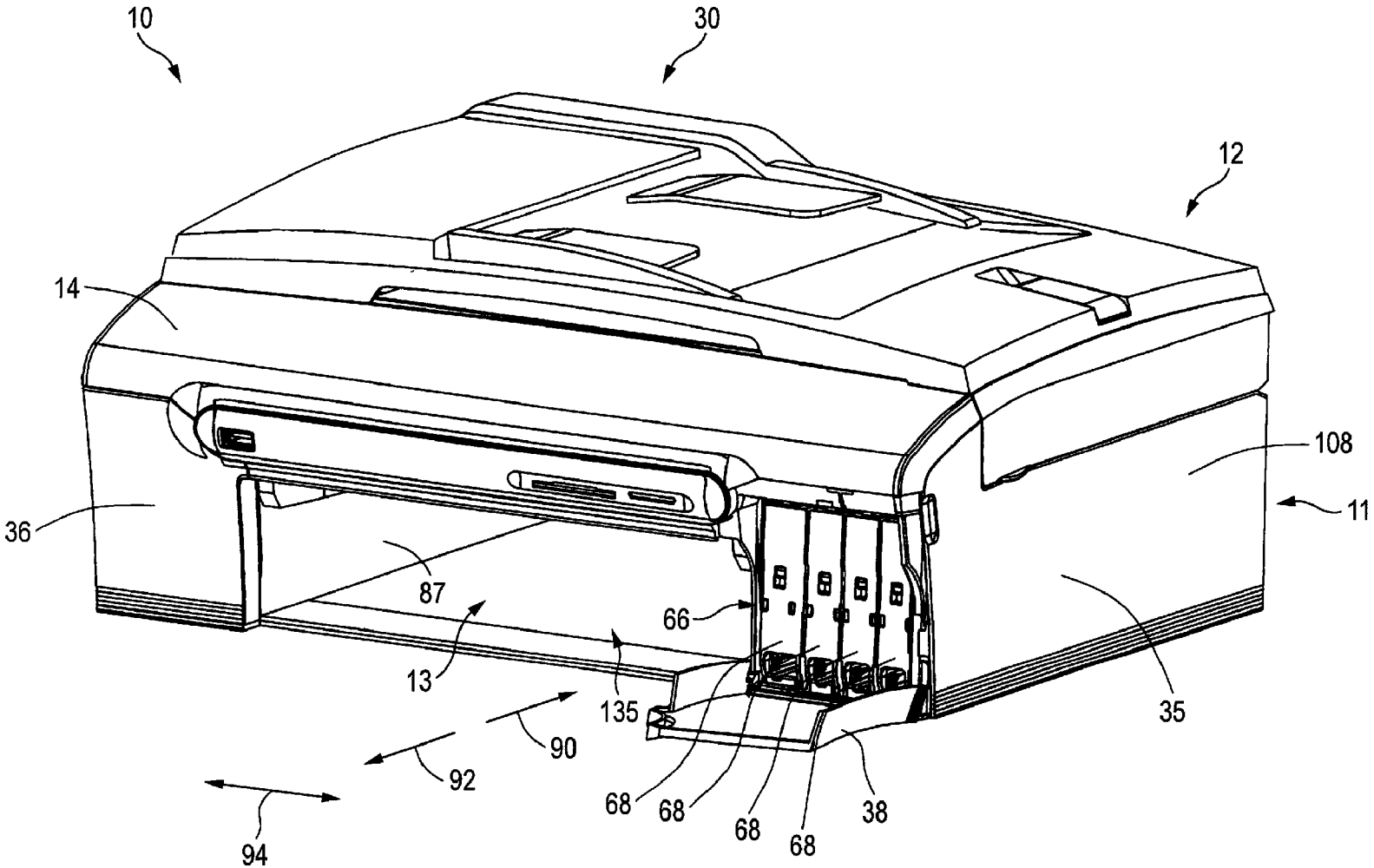
FIG. 1 is a perspective view illustrating an appearance of a multi function device according to an embodiment of the invention.
Figure 2:
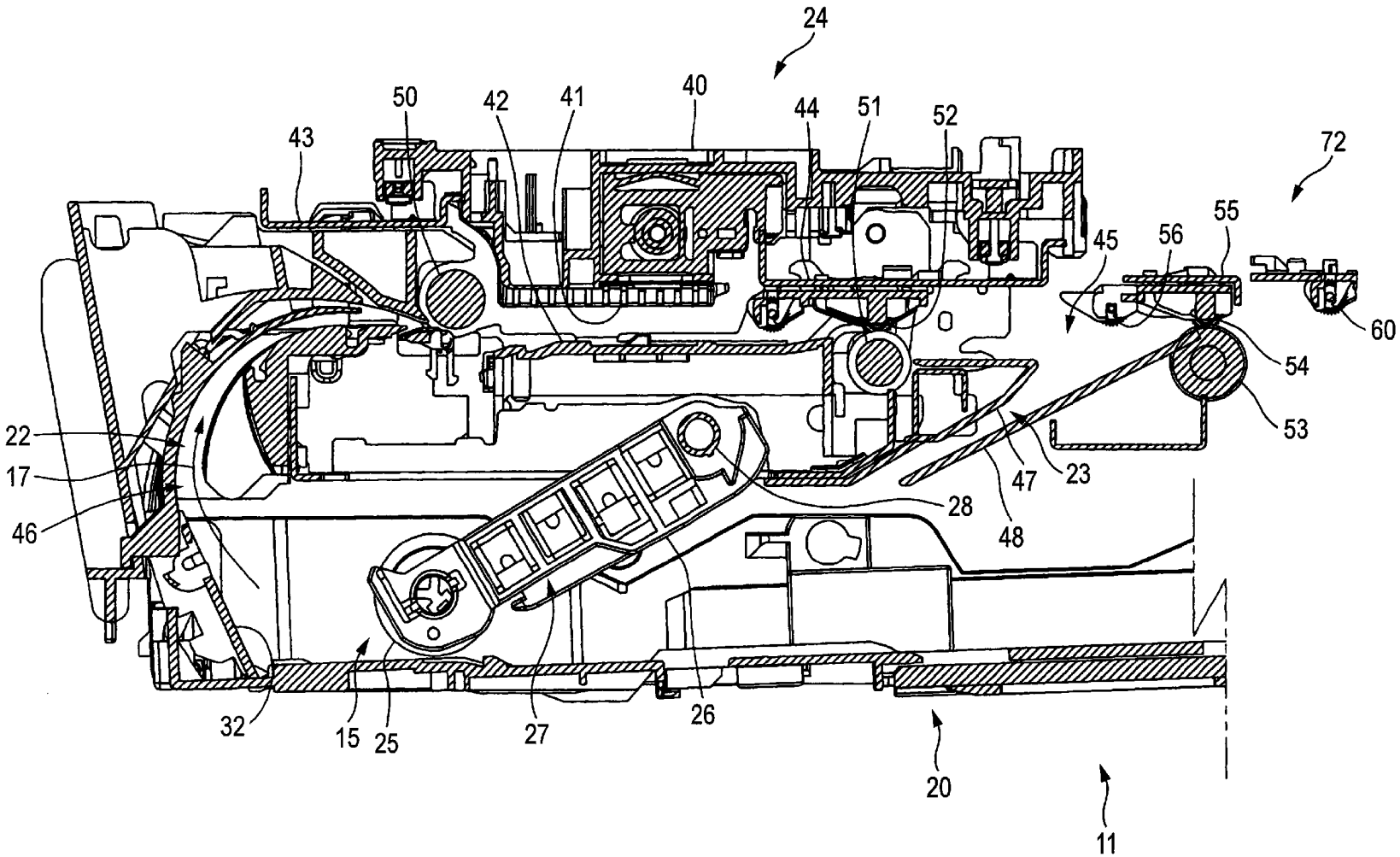
FIG. 2 is a longitudinal sectional view illustrating an inner structure of a printer unit.

FIG. 1 is a perspective view illustrating an appearance of a multi function device (MFD) 10 according to an embodiment of the invention. FIG. 2 is a longitudinal sectional view illustrating an inner structure of a printer unit 11. In FIG. 2, a part of a sheet feed tray 20 (see also FIGS. 4 and 5) and a sheet discharge tray 21 (see also FIG. 4) are omitted.

As shown in FIG. 1, the multi function device 10 includes a printer unit 11 and a scanner unit 12 and has a printing function, a scanning function, a copying function, and a facsimile function. An example of the image recording apparatus is embodied as the printer unit 11 of the multi function device 10 in this embodiment. Accordingly, the functions other than the printing function are arbitrary. In this embodiment, the printer unit 11 is an ink jet printer using ink to record an image. The printer unit 11 may be a laser printer using toner to record an image.

The multi function device 10 is connectable to an external information device (not shown) such as a computer. The multi function device 10 can receive print data including image data or document data transmitted from the external information device. The multi function device 10 can record an image on a recording sheet as an example of a recording medium on the basis of the print data. The multi function device 10 can also record an image on the printing sheet on the basis of the image data of a document read by the scanner unit 12. The multi function device 10 may be connectable to a digital camera and may record an image on the recording sheet on the basis of the image data output from the digital camera. The multi function device 10 may support various storage media such as a memory card inserted thereto and records an image on the recording sheet on the basis of image data stored in the storage medium.

As shown in FIG. 1, the multi function device 10 has a substantially wide-and-thin rectangular parallelepiped shape having a horizontal width and an inner depth grater than the height thereof. The printer unit 11 has an opening 13 on a front surface 36 of a main body 35. The opening 13 allows a user to take out the recording sheet on which an image is recorded and discharged in a space 135. The space 135 is provided with a sheet feed cassette 70 (see FIG. 4) storing the recording sheet. The sheet feed cassette 70 includes a sheet feed tray 20 and a sheet discharge tray 21 (see FIG. 4). Recording sheets used to record an image are placed on the sheet feed tray 20. The recording sheets having an image recorded thereon are discharged to the sheet discharge tray 21. The sheet feed cassette 70 is omitted in FIG. 1.

A door 38 (see FIG. 1) is disposed on the lower right side of the front surface 36 of the main body 35 so as to be freely opened and closed. A cartridge mounting section 66 is disposed inside the door 38. As shown in FIG. 1, when the door 38 is opened, the cartridge mounting section 66 is exposed from the front surface 36 of the main body 35. Accordingly, ink cartridges 68 can be inserted into and drawn out of the cartridge mounting section 66. The ink cartridges 68 are mounted on the cartridge mounting section 66 and are thus connected to an ink jet recording head 41 (see FIG. 2) through ink tubes. The ink jet recording head 41 records an image on the recording sheet by ejecting ink supplied from the ink cartridges 68.

The scanner unit 12 is provided at the upper portion of the multi function device 10. The scanner unit 12 includes a flat bed scanner (FBS) and an automatic document feeder (ADF). As shown in FIG. 1, a document cover 30 is disposed as the top plate of the multi function device 10 so as to be freely opened and closed. The ADF is disposed in the document cover 30. Although not shown in the drawings, a platen glass and an image sensor are disposed in the lower portion of the document cover 30. In the scanner unit 12, an image of a document placed on the platen glass or a document fed by the ADF is read by the image sensor.

An operation panel 14 is disposed in the upper portion of the front surface of the multi function device 10 (see FIG. 1). The operation panel 14 includes a liquid crystal display configured to display various information and input keys configured to accept information from an external input such as user's input. The liquid crystal display and the input keys are omitted in FIG. 1. The multi function device 10 operates on the basis of information input from the operation panel 14 or transmitted from the external information apparatus.

<Printer Unit 11>

The configuration of the printer unit 11 will be described in detail now.

As shown in FIG. 1, the opening 13 is disposed at the center of the front surface 36 of the printer unit 11. The sheet feed cassette 70 (see FIG. 5) can be inserted into and drawn out of the main body 35 through the opening 13. That is, the sheet feed cassette 70 can be inserted into the main body 35 in an insertion direction 90 and can be drawn out of the main body 35 in the drawing direction 92. The insertion direction 90 is a direction in which the sheet feed tray 20 (sheet feed cassette 70) is inserted into the main body 35 through the opening 13. The drawing direction 92 is a direction in which the sheet feed tray 20 (sheet feed cassette 70) is drawn out of the main body 35.

As shown in FIG. 2, the printer unit 11 includes a sheet feed tray 20, a feed roller 25 as an example of a feeding member, an arm 26, and a power transmitting mechanism 27.

As shown in FIG. 2, the feed roller 25 is disposed above the sheet feed tray 20. The feed roller 25 is configured to feed a recording sheet on the sheet feed tray 20 to a first conveying path 22. The arm 26 is disposed above the sheet feed tray 20. The feed roller 25 is rotatably disposed at an end of the arm 26. The feed roller 25 uses a motor (not shown) as a drive source and rotates with the power transmitted through the power transmitting mechanism 27. The power transmitting mechanism 27 includes plural gears which engage with each other in series.

Figure 4:
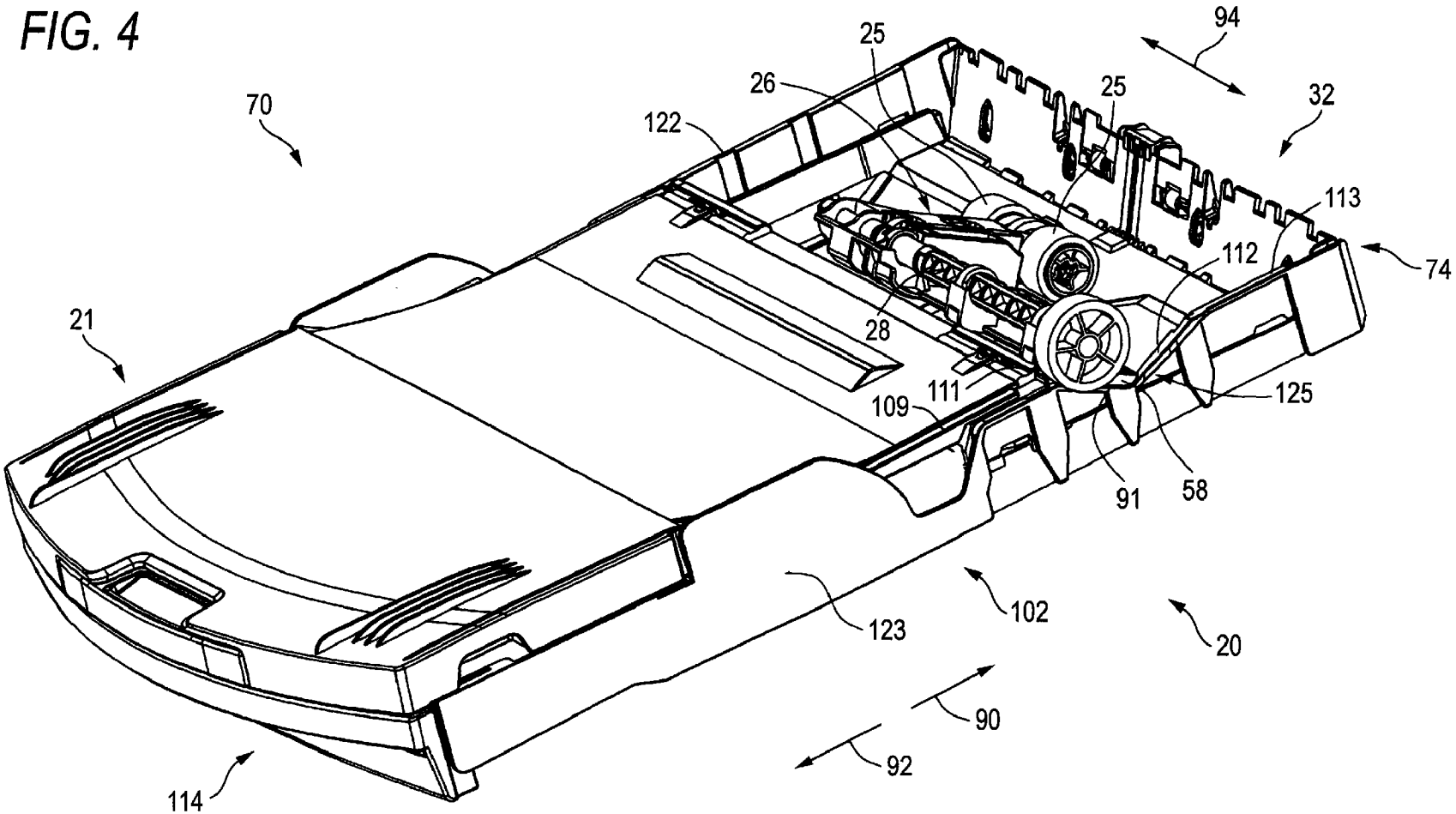
FIG. 4 is a perspective view illustrating a sheet feed cassette, where a feed roller is supported from the downside by a sheet feed tray.

The arm 26 is supported by a base shaft 28 (see also FIG. 4). The base end of the arm 26 is supported by the base shaft 28. Accordingly, the arm 26 can pivot about the base shaft 28 in a direction such that the arm 26 moves to and moves away from the sheet feed tray 20. The arm 26 is urged toward the sheet feed tray 20 by the weight of the arm 26 or the feed roller 25 or by a spring.

By urging the arm 26 downward, the feed roller 25 comes in pressing contact with the recording sheet placed on the sheet feed tray 20. When the feed roller 25 is rotationally driven in this state, the uppermost recording sheet on the sheet feed tray 20 is sent to a slope plate 32 with a frictional force occurring between the roller surface of the feed roller 25 and the recording sheet. When the end of the recording sheet contacts with the slope plate 32, the uppermost sheet of the stack of recording sheets is separated and guided upward. In this way, the recording sheets are fed from the sheet feed tray 20 to the first conveying path 22 sheet by sheet.

The first conveying path 22 is disposed above the slope plate 32. The first conveying path 22 extends upward from the slope plate 32 and is bent in a lateral U shape toward the front surface 36 (to the right side of FIG. 2). The first conveying path 22 extends from the rear surface of the multi function device 10 (from the left side of FIG. 2) to the front surface 36 and extends to the sheet discharge tray 21 (see FIG. 4) through the recording section 24. The recording sheet fed from the sheet feed tray 20 is conveyed along the first conveying path 22. The recording sheet is guided along the first conveying path 22 in a U shape from the downside to the upside, and reaches the recording section 24. An image is recorded on the recording sheet by the recording section 24. The recording sheet having an image recorded thereon in the course of conveying the recording sheet along the first conveying path 22 is discharged to the sheet discharge tray 21.

As shown in FIG. 2, the recording section 24 is discharged in the middle way of the first conveying path 22 extending from the rear surface of the multi function device 10 to the front surface 36 (to the right side of FIG. 2; see FIG. 1). The recording section 24 is configured to record an image on the recording sheet in the course of conveying the recording sheet along the first conveying path 22. The recording section 24 includes a carriage 40, an ink jet recording head 41, and a platen 42. The ink jet recording head 41 is mounted on the carriage 40. The carriage 40 reciprocates in the width direction of the recording sheet (in the direction perpendicular to the paper surface in FIG. 2) along guide rails 43 and 44. Although not shown in FIG. 2, the guide rail 44 is provided with a belt driving mechanism using a motor as a driving source. As an example of the belt driving mechanism, a driving pulley and a driven pulley are disposed at both ends in the width direction of the guide rail 44 and an endless driving belt is suspended on the driving pulley and the driven pulley. By connecting the carriage 40 to the driving belt of the belt driving mechanism, the driving force of the motor is transmitted to the carriage 40 through the belt driving mechanism and thus the carriage 40 reciprocates.

The first conveying path 22 is provided with the platen 42 facing the ink jet recording head 41. The platen 42 supports the recording sheet conveyed through the first conveying path 22 from the downside. The recording sheet and the ink jet recording head 41 are supported with a predetermined head gap by the platen 42. Color ink stored in the ink cartridges 68 (see FIG. 1) are supplied to the ink jet recording head 41 through the ink tube. While the carriage 40 is reciprocating, the color ink is selectively ejected as minute ink droplets to the platen 42 from the ink jet recording head 41. An image is recorded on the recording sheet conveyed over the platen 42 by the recording section 24 in the course of conveying the recording sheet.

A second conveying path 23 is configured to guide to the sheet feed tray 20 the recording sheet 65 with an image recorded on one surface thereof (recording surface 64; see FIG. 3) and conveyed in a switch-back manner. That is, the second conveying path 23 is a path through which the recording sheet 65 having been conveyed through the first conveying path 22 is conveyed in the switch-back manner. As shown in FIG. 2, the second conveying path 23 connects the first conveying path 22 and the sheet feed tray 20. One end of the second conveying path 23 is connected to the downstream side (downstream portion 45) of the recording section 24 in the first conveying path 22. The other end of the second conveying path 23 is connected to the upstream side (right side in FIG. 2) of the sheet feed tray 20 from the feed roller 25. The downstream side (left side in FIG. 2) of the sheet feed tray 20 from the feed roller 25 is connected to the first conveying path 22 through the slope plate 32. Accordingly, the second conveying path 23 is connected to the upstream side (upstream portion 46) of the recording section 24 in the first conveying path 22 through the sheet feed tray 20.

The second conveying path 23 is defined by a pair of upper guide member 47 and lower guide member 48 disposed to face each other with a predetermined gap. The upper guide member 47 and the lower guide member 48 extend obliquely downward to the upstream side of the feed roller 25 from the downstream portion 45 of the first conveying path 22.

A conveying section 15 is configured to convey the recording sheet along the first conveying path 22 and the second conveying path 23. The conveying section 15 includes the feed roller 25, a conveying roller 50, a discharge roller 51, and a path switching section 72.

As shown in FIG. 2, the conveying roller 50 is disposed on the upstream side (left side in FIG. 2) in the recording sheet conveying direction from the recording section 24 in the first conveying path 22. Although not shown in the drawing, a pinch roller pressed on the conveying roller 50 is disposed on the downstream side of the conveying roller 50. The conveying roller 50 is disposed to extend in the width direction (direction perpendicular to the paper surface in FIG. 2) of the first conveying path 22. Plural pinch rollers are disposed with a predetermined gap in the width direction of the first conveying path 22. The recording sheet conveyed through the first conveying path 22 is interposed by the conveying roller 50 and the pinch roller and is conveyed onto the platen 42.

As shown in FIG. 2, the discharge roller 51 and a spur 52 are disposed on the downstream side from the recording section 24 in the first conveying path 22. The spur 52 is disposed above the discharge roller 51 and is brought into pressing contact with the discharge roller 51. The discharge roller 51 is disposed in the width direction of the first conveying path 22. Plural spurs 52 are disposed with a predetermined gap in the width direction of the first conveying path 22. The recording sheet with an image recorded thereon is interposed by the discharge roller 51 and the spurs 52 and is conveyed to the downstream portion 45 of the first conveying path 22. The conveying roller 50 and the discharge roller 51 are driven using a motor (not shown) as a driving source.

As shown in FIG. 2, the path switching section 72 is disposed in the downstream portion 45 of the first conveying path 22. The path switching section 72 is configured to select one of the sheet discharge tray 21 (see FIG. 4) the second conveying path 23 (see FIGS. 2 and 3), to which the recording sheet having been conveyed through the first conveying path 22 is to be sent. The path switching section 72 includes a switch-back roller 53, a spur 54, a frame 55, and a spur 56.

As shown in FIG. 2, the switching-back roller 53 and the spur 54 are disposed just below of the downstream portion 45 of the first conveying path 22. The spur 54 is disposed above the switch-back roller 53 and is pressed on the switch-back roller 53. The switch-back roller 53 is disposed in the width direction of the first conveying path 22. Plural spurs 54 are disposed with a predetermined gap in the width direction of the first conveying path 22. The recording sheet having been conveyed through the first conveying path 22 is discharged to the sheet discharge tray 21 by the switch-back roller 53 and the spurs 54. The recording sheet having been conveyed through the first conveying path 22 is conveyed through the second conveying path 23 by the switch-back roller 53 and the spurs 54 in the switch-back manner.

The switch-back roller 53 is driven using a motor (not shown) as a driving source. The switch-back roller 53 can rotate in the forward and backward directions. The rotation direction of the switch-back roller 53 is controlled by means of the forward and backward rotation of the motor. The "forward rotation" and the "backward rotation" of the switch-back roller 53 are relative. In this embodiment, the rotation for sending the recording sheet to the sheet discharge tray 21 is called the "forward rotation" and the rotation for sending the recording sheet to the second conveying path 23 is called the "backward rotation".

The spurs 54 are supported by the frame 55 and slidable to move to and move away from the switch-back roller 53. Although not shown in detail in FIG. 2, the rotation shaft of the spurs 54 is elastically urged by a coil spring to always be pressed on the switch-back roller 53. Accordingly, when the switch-back roller 53 rotates, the spurs 54 also rotate with the rotation thereof.

Figure 3:
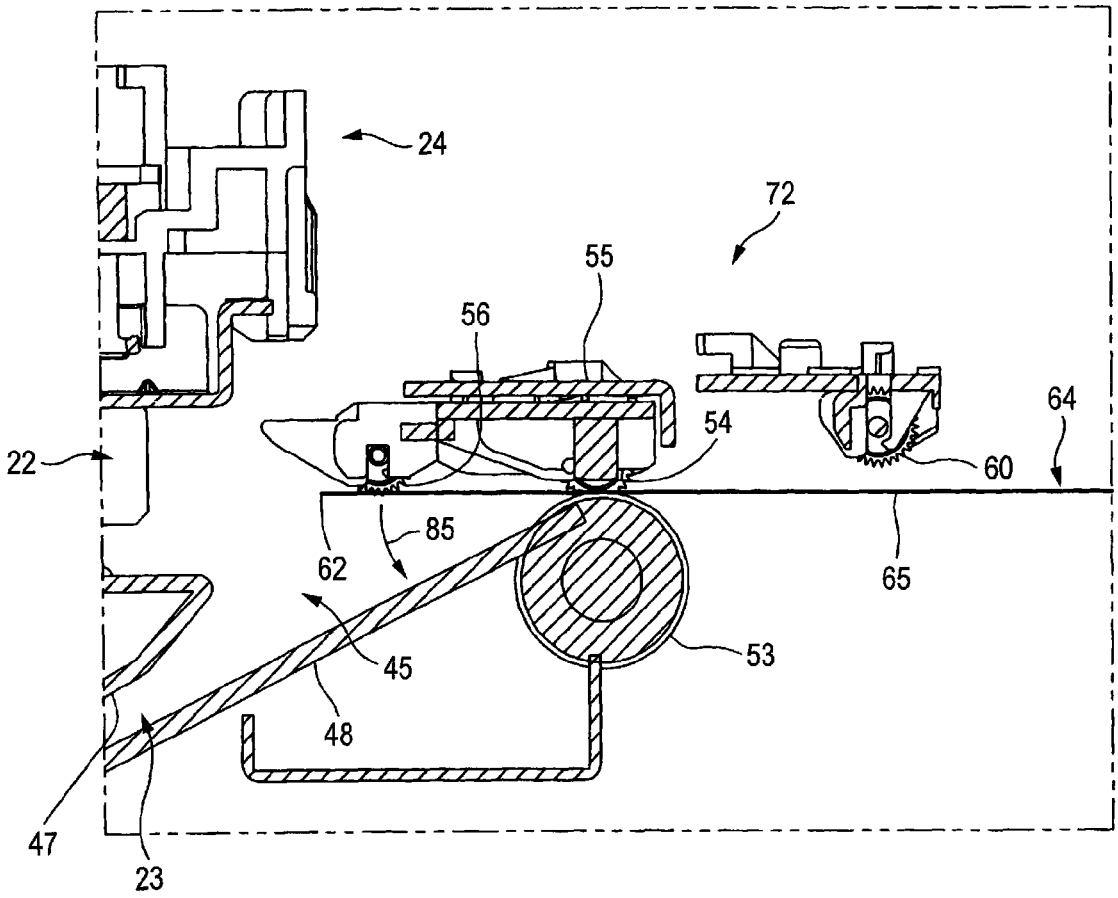
FIG. 3 is an enlarged sectional view of a path switching section, where a frame is maintained in a horizontal posture.

FIG. 3 is an enlarged sectional view illustrating the path switching section 72, where the frame 55 is maintained in a horizontal posture.

The path switching section 72 includes the frame 55 and the spur 56. The switch-back roller 53 is rotatably supported by the frame 55. The frame 55 extends from the switch-back roller 53 to the upstream side in the conveying direction (to the left side in FIG. 3) and reaches to the downstream portion 45. The spur 56 is rotatably supported by the extension end of the frame 55 and the spur 56 is disposed in the downstream portion 45. The frame 55 extends in the width direction (direction perpendicular to the paper surface of FIG. 3) of the first conveying path 22. Plural spurs 56 are disposed with a predetermined gap in the width direction of the first conveying path 22.

The extension end of the frame 55 is rotatable about the rotation shaft of the switch-back roller 53. The driving force of a motor (not shown) is transmitted to the frame 55. Accordingly, the frame 55 enters into the rotation posture in which the frame rotates in the direction indicated by an arrow 85 from the state shown in FIG. 3. The spurs 54 supported by the base end of the frame 55 and the spurs 56 supported by the extension end of the frame 55 rotate around the rotation shaft of the switch-back roller 53 along with the frame 55. The recording sheet 65 is guided and discharged to the sheet discharge tray 21 by the frame 55 having the horizontal posture. The recording sheet 65 is guided to pass through the second conveying path 23 by the frame 55 having the rotation posture.

<Sheet Feed Cassette 70>

Figure 5:
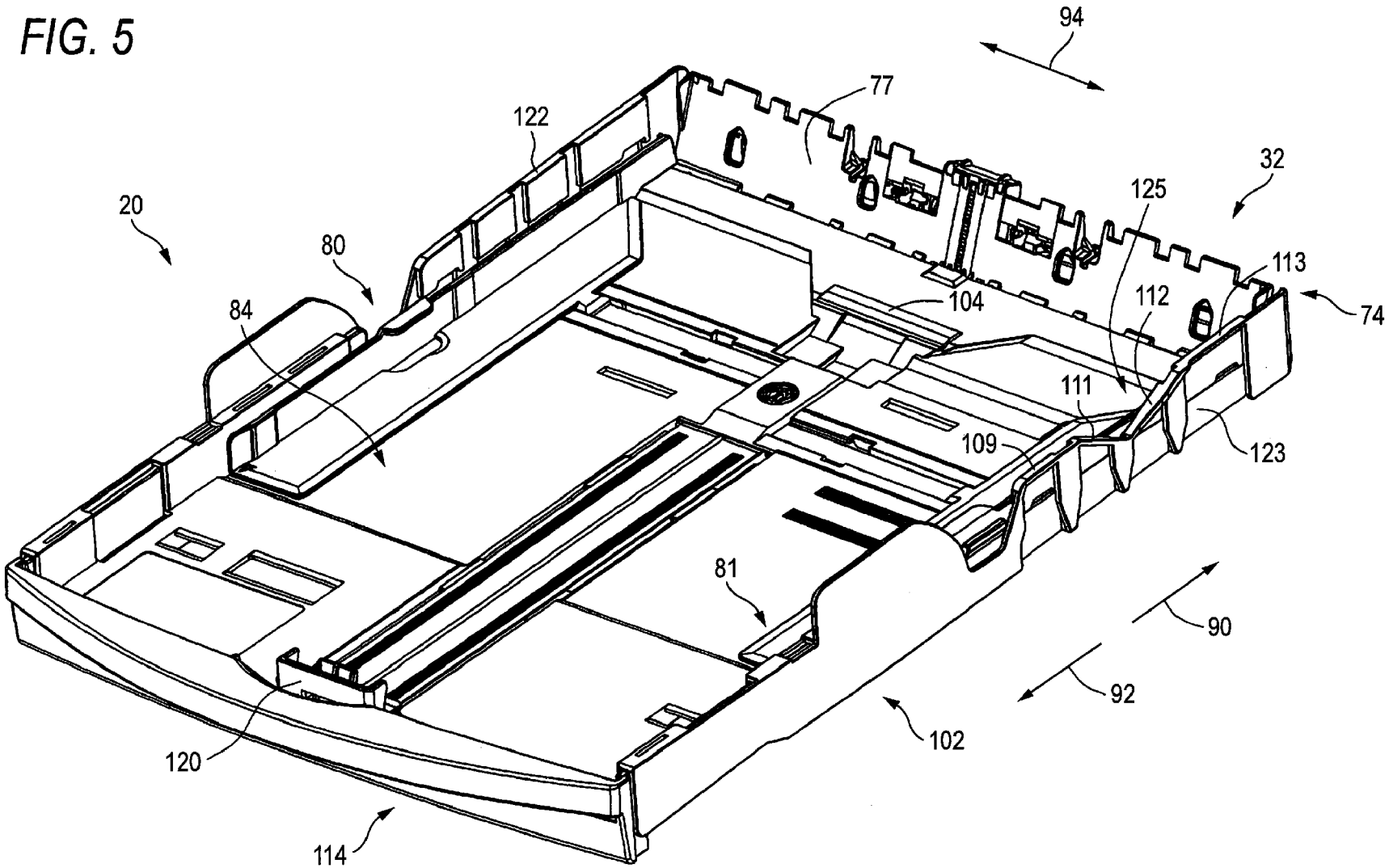
FIG. 5 is a perspective view illustrating a configuration of a sheet feed tray.

FIG. 4 is a perspective view illustrating the sheet feed cassette 70, where the feed roller 25 is supported from the downside by the sheet feed tray 20. FIG. 5 is a perspective view illustrating a configuration of the sheet feed tray 20.

As shown in FIG. 4, the sheet feed cassette 70 is formed in a thin rectangular shape as a whole in plan view and includes the sheet feed tray 20 and the sheet discharge tray 21. The sheet feed tray 20 and the sheet discharge tray 21 are disposed to form two vertical stages in which the sheet discharge tray 21 is disposed above the sheet feed tray 20. The sheet feed cassette 70 can be inserted into the main body 35 and can be drawn out of the main body 35 through the opening 13 (see FIG. 1). The sheet feed tray 20 and the sheet discharge tray 21 are incorporated into the sheet feed cassette 70. Accordingly, the sheet discharge tray 21 is inserted to and drawn out of the main body 35 with the insertion and drawing of the sheet feed tray 20.

The sheet feed cassette 70 is inserted into the opening 13 of the main body 35 and is mounted on the main body 35. Accordingly, as shown in FIG. 4, the sheet feed tray 20 is disposed below the arm 26 and the feed roller 25. The base shaft 28 of the arm 26 is rotatably disposed in the main body 35, where the axial direction thereof is parallel to a first direction 94. Here, the first direction 94 is substantially horizontal and substantially perpendicular to the drawing direction 92 of the sheet feed tray 20. As shown in FIG. 4, the base shaft 28 extends from the center portion in the width direction (the first direction 94) of the sheet feed tray 20 over a side wall 123. The base shaft 28 rotates around the axial direction using a motor (not shown) as a driving source. The rotation of the base shaft 28 is transmitted to the feed roller 25 through the power transmitting mechanism 27 and thus the feed roller 25 rotates.

The sheet discharge tray 21 is rotatable upward relative to the sheet feed tray 20, where the axial direction is the width direction (the first direction 94) of the sheet feed cassette 70. When the sheet discharge tray 21 rises up relative to the sheet feed tray 20, the top surface of the sheet feed tray 20 is opened and thus recording sheets can be placed on the sheet feed tray 20. When the sheet discharge tray 21 falls down relative to the sheet feed tray 20, the top surface of the sheet feed tray 20 is covered with the sheet discharge tray 21 (see FIG. 4). In this state, the sheet discharge tray 21 receives the recording sheet from the first conveying path 22 (see FIG. 2) and serves as a cover of the sheet feed tray 20. As shown in FIG. 4, the upper portion in a deep side (the side of the insertion direction 90) of the sheet feed tray 20 is opened to receive the feed roller 25 or the arm 26.

<Sheet Feed Tray 20>

As shown in FIG. 5, the sheet feed tray 20 is formed substantially in a tray shape which is longitudinal in the insertion direction 90 and the drawing direction 92 in plan view. The sheet feed tray 20 includes a tray body 102 and an extension tray 114 (see FIG. 3). In the sheet feed tray 20, the extension tray 114 can slide in the insertion direction 90 and the drawing direction 92 relative to the tray body 102. The extension tray 114 slides in the insertion direction 90 or the drawing direction 92 relative to the tray body 102 as needed. Accordingly, the sheet placing surface of the sheet feed tray 20 is expanded or reduced depending on the position of the extension tray 114, thereby the sheet feed tray 20 can support various sizes of recording sheets.

As shown in FIG. 5, the tray body 102 is formed in a rectangular shape which is longitudinal in the insertion direction 90 and the drawing direction 92. The tray body 102 includes a bottom plate 84. The recording sheets are placed on the bottom plate 84. The slope plate 32 is disposed at the end 74 of the tray body 102. The slope plate 32 is a plate-like member longitudinal in the width direction (the first direction 94) of the tray body 102. The slope plate 32 is tilted toward the rear surface (in the insertion direction 90). Accordingly, when the end of the recording sheet contacts with the slope plate 32, the end is guided obliquely upward along the inner side surface 77 of the slope plate 32. That is, the inner side surface 77 serves as a guide surface guiding the recording sheet to the first conveying path 22 (see FIG. 2).

As shown in FIG. 5, a frictional member 104 is disposed at the center portion of the tray body 102 in the first direction 94. The frictional member 104 is made of cork or rubber having a high friction constant with the recording sheet. In this embodiment, two feed rollers 25 are disposed on both sides in the first direction 94 of the end of the arm 26 (see FIG. 4). Two feed rollers 25 move to the sheet feed tray 20 with the rotation of the arm 26. Accordingly, the feed rollers 25 are disposed just above the frictional member 104. When the sheet feed tray 20 with the recording sheets placed thereon is inserted into the main body 35, the feed roller 25 is brought into pressing contact with the recording sheet on the sheet feed tray 20. Accordingly, the recording sheets are interposed between the frictional member 104 and the feed roller 25. A frictional force in the insertion direction 90 is applied to the uppermost recording sheet of plural recording sheets interposed between the frictional member 104 and the feed roller 25 from the feed roller 25. On the contrary, a frictional force in the drawing direction 92 is applied to the lower recording sheets from the feed roller 25. The number of the feed rollers 25 is not limited to two. For example, one feed roller 25 may be disposed at the end of the arm 26.

A pair of side guides 80 and 81 is disposed in the tray body 102. The side guides 80 and 81 are configured to regulate the position in the width direction of the recording sheets placed on the sheet feed tray 20 to correspond to the center in the width direction of the sheet feed tray 20. One of the side guides 80 and 81 slides in the first direction 94. Then, the other of the side guides 80 and 81 slides in the opposite direction. Accordingly, when the width of the recording sheets placed on the sheet feed tray 20 is smaller than the separation gap between the side guides 80 and 81, one of the side guides 80 and 81 is made to slide, whereby the side guides 80 and 81 simultaneously move. As a result, the center position in the width direction of the recording sheets substantially corresponds to the center in the width direction of the sheet feed tray 20.

A rear guide 120 is disposed at the center portion of the tray body 102 in the first direction 94. The rear guide 120 is configured to regulate the movement of the recording sheets placed on the sheet feed tray 20 to the rear end (in the drawing direction 92) of the tray body 102. The rear guide 120 is slidable along the insertion direction 90 in a state where the recording sheets are placed on the sheet feed tray 20. Then, the rear guide 120 contacts with the rear ends of the recording sheets. As a result, the rear ends of the recording sheets can be arranged and are regulated at the position corresponding to the size of the recording sheets. The ends of the recording sheets are positioned at a predetermined position in the sheet feed tray 20 close to the slope plate 32, regardless of the size of the recording sheets.

<Cam 125 and Cam Follower 58>

As shown in FIG. 4, a cam follower 58 is disposed below the base shaft 28. The cam follower 58 is configured to transmit to the arm 26 the motion of a cam 125 resulting from the insertion or drawing of the sheet feed tray 20 (sheet feed cassette 70) relative to the main body 35. The cam follower 58 is fixed to the base shaft 28 and the arm 26. The cam follower 58 extends from the arm 26 to above the cam 125 in the first direction 94. The cam follower 58 extends from the base shaft 28 to be substantially parallel to the arm 26. The cam follower 58 has a plane 91 substantially parallel to the longitudinal direction of the arm 26. The plane 91 is a surface to be contact with the cam 125.

As shown in FIG. 4, side walls 122 and 123 facing to each other and in the first direction 94 are disposed in the tray body 102. The side walls 122 and 123 rise up vertically from the bottom plate 84 of the tray body 102. The cam 125 is formed on a side of the side wall 123 along the insertion direction 90. The cam 125 is configured to transmit to the cam follower 58 the motion of the sheet feed tray 20 resulting from the insertion or drawing of the sheet feed tray 20 relative to the main body 35. In other words, the cam 125 is configured to transmit to the cam follower 58 the motion of the sheet feed tray 20 in the insertion direction 90 or the drawing direction 92.

As shown in FIG. 5, the cam 125 includes a first inclined surface 111, a second inclined surface 112, and a horizontal surface 113. The first inclined surface 111, the second inclined surface 112, and the horizontal surface 113 are continuously formed from the top surface 109 of the side wall 123 to the end 74 of the tray body 102 in the insertion direction 90. The top surface 109 and the horizontal surface 113 have substantially the same height from the bottom plate 84. The first inclined surface 111 and the second inclined surface 112 are disposed between the top surface 109 and the horizontal surface 113. The first inclined surface 111 is inclined downward in the insertion direction 90 between the top surface 109 and the second inclined surface 112. The second inclined surface 112 is inclined upward in the insertion direction 90 between the first inclined surface 111 and the horizontal surface 113. The horizontal surface 113 is disposed between the second inclined surface 112 and the end 74 of the tray body 102 so as to be substantially parallel to the top surface 109. In this way, the cam 125 is formed at the side wall 123 so that the height from the bottom plate 84 (see FIG. 5) varies in the insertion direction 90 and the drawing direction 92.

In this embodiment, the cam 125 is formed in one side wall 123 of the side walls 122 and 123 facing the first direction 94. The cam 125 may be formed at the side wall 122, not in the side wall 123. In this case, the base shaft 28 and the cam follower 58 extend from the base end of the arm 26 to the side wall 122. The cam 125 may be formed at both the side walls 122 and 123. In this case, the base shaft 28 and the cam follower 58 are made to extend from the base end of the arm 26 to the side wall 122 and the side wall 123.

<Frame 133>

Figure 6:
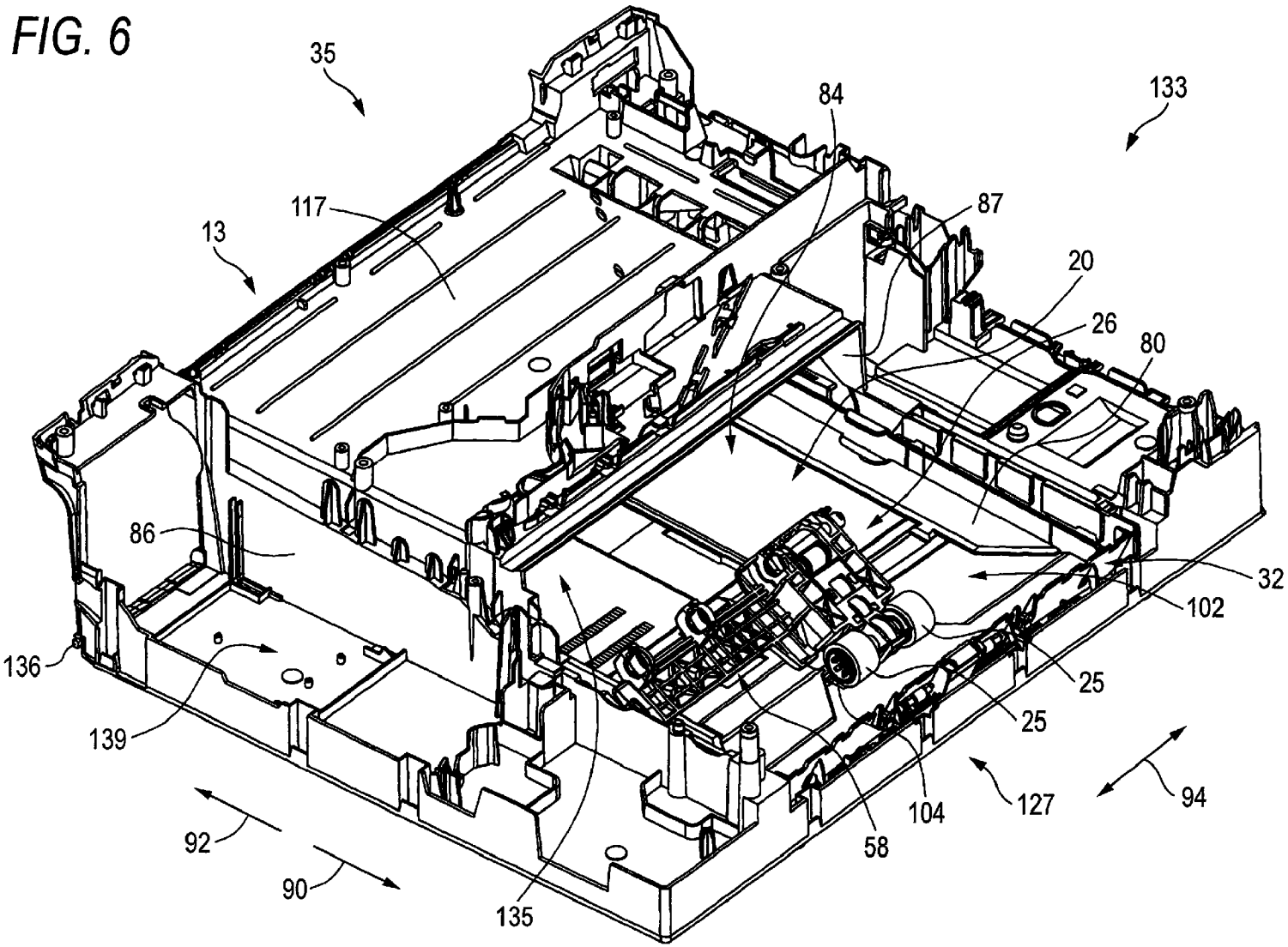
FIG. 6 is a perspective view illustrating a frame, where the sheet feed tray is inserted into a main body.
Figure 7:
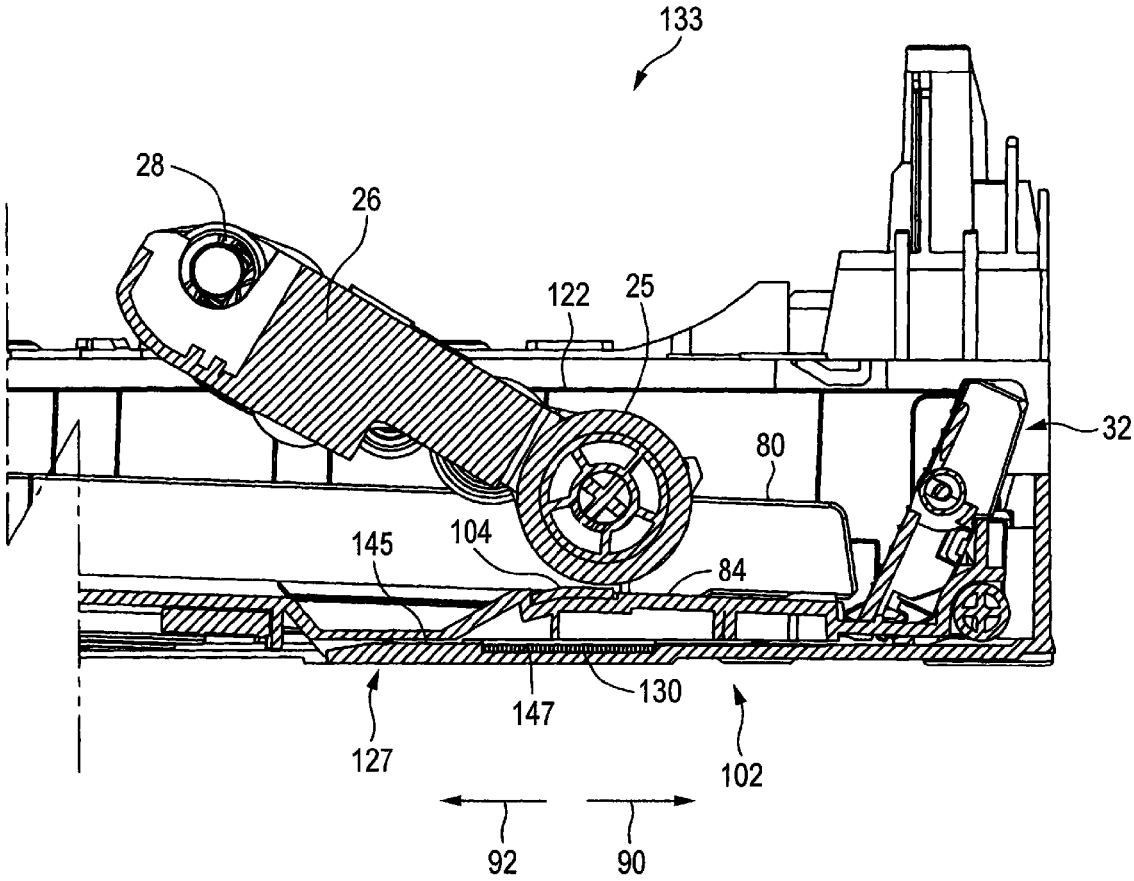
FIG. 7 is an enlarged sectional view illustrating an arm, where the sheet feed tray is inserted into the main body.
Figure 8:
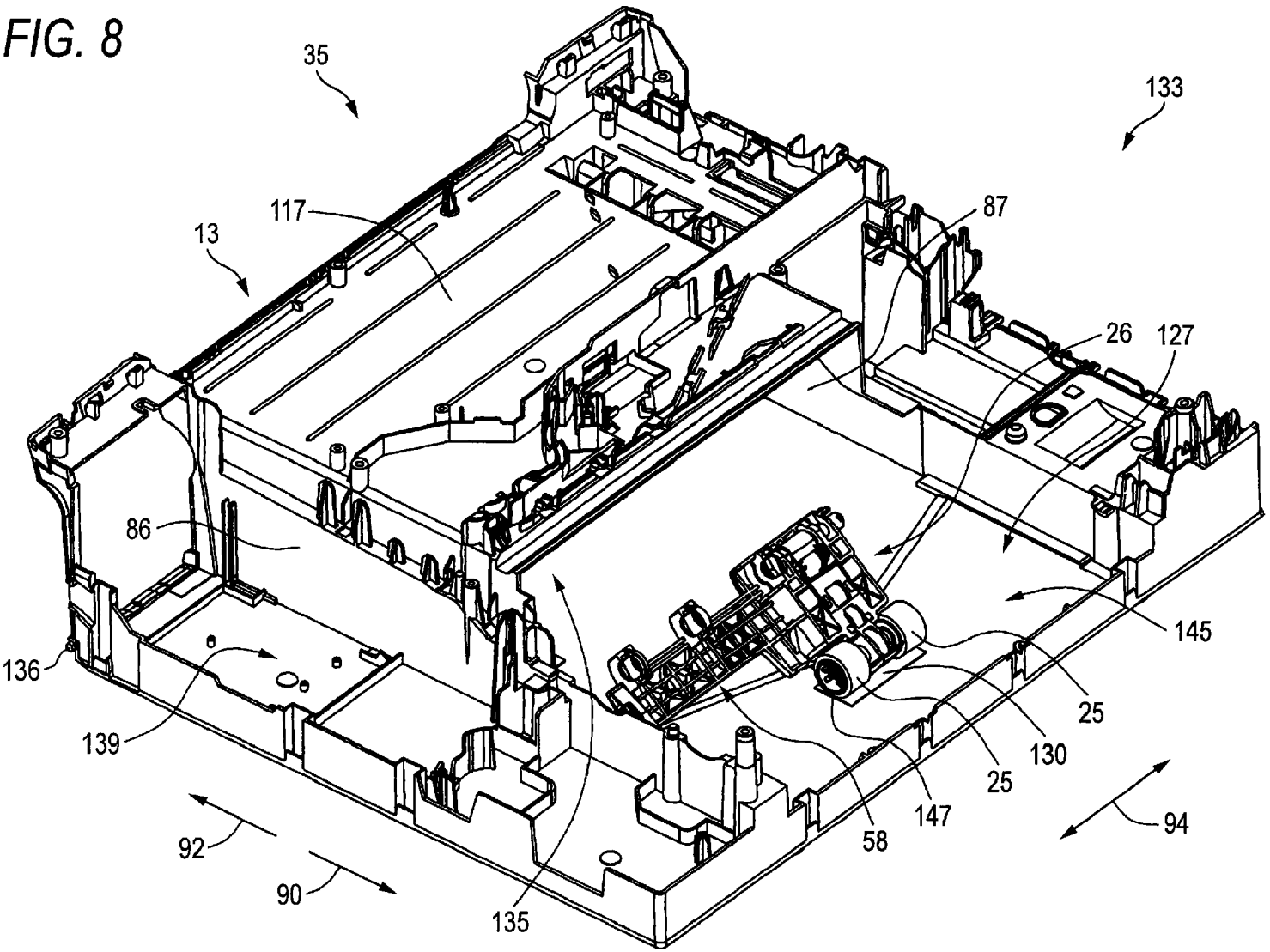
FIG. 8 is an enlarged sectional view illustrating the frame, where the sheet feed tray is drawn from the main body.
Figure 9:
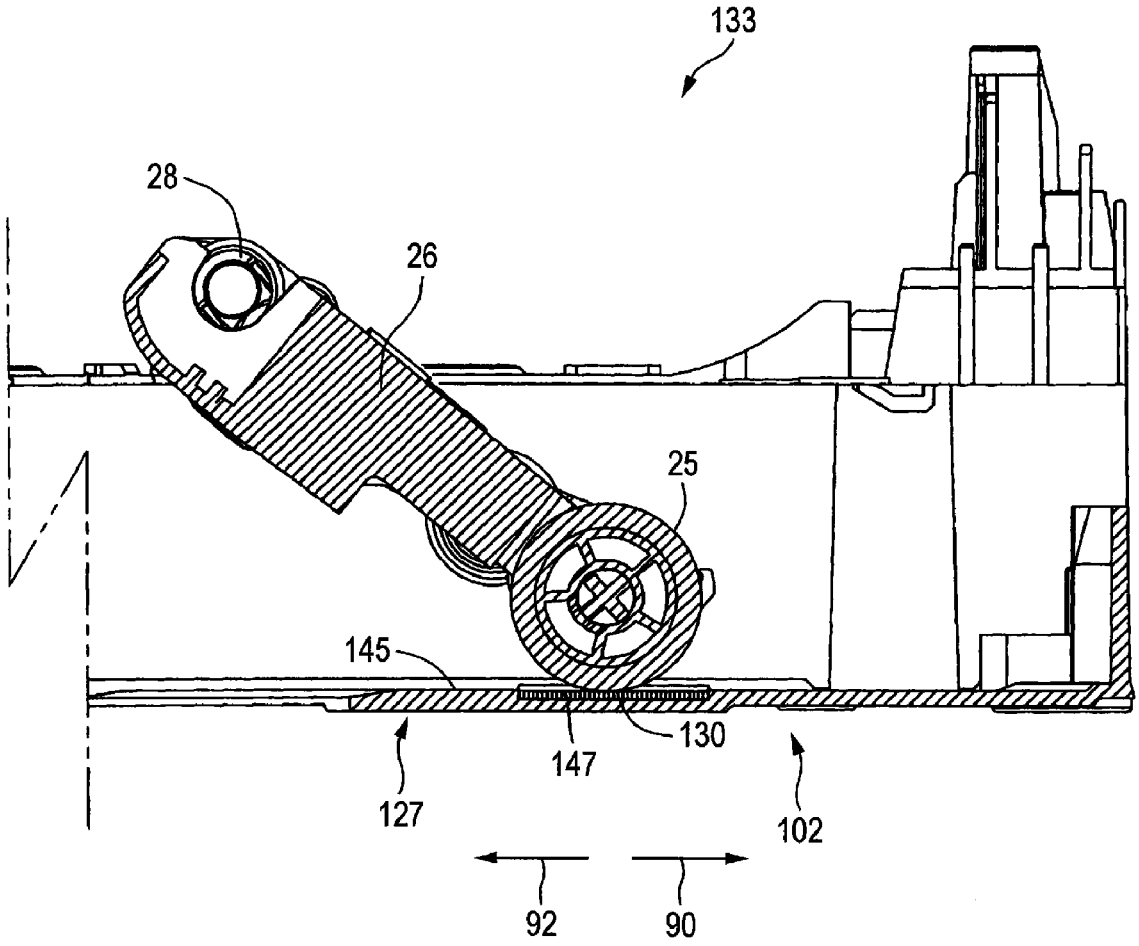
FIG. 9 is an enlarged sectional view illustrating the arm, where the sheet feed tray is drawn from the main body.

FIG. 6 is a perspective view illustrating the frame 133, where the sheet feed tray 20 is inserted into the main body 35. FIG. 7 is an enlarged sectional view of the arm 26, where the sheet feed tray 20 is inserted into the main body 35. FIG. 8 is a perspective view of the frame 133, where the sheet feed tray 20 is drawn out of the main body 35. FIG. 9 is an enlarged sectional view of the arm 26, where the sheet feed tray 20 is drawn out of the main body 35. The base shaft 28 is omitted in FIGS. 6 and 8.

The main body 35 is constructed by attaching the cover 108 (see FIG. 1) to the frame 133 (see FIGS. 6 and 8). The frame 133 maintains elements of the multi function device 10. As shown in FIGS. 6 and 8, the frame 133 includes a separation plate 117 at a position close to the front surface 36 (in the drawing direction 92) of the main body 35 and at the center in the width direction (the first direction 94). The separation plate 117 is mounted with the operation panel 14 (see FIG. 1) or a control board (not shown) of the multi function device 10. As shown in FIGS. 6 and 8, walls 86 and 87 are disposed on both edges of the separation plate 117. The walls 86 and 87 extend vertically downward from the ends of the separation plate 117 in the width direction (the first direction 94). The space 135 (see FIG. 1) is defined below the separation plate 117 by the separation plate 117 and the walls 86 and 87. The sheet feed tray 20 is inserted into the main body 35 through the opening 13 and is disposed in the space 135.

As shown in FIGS. 6 and 8, the frame 133 includes a shaft 136 at a position close to the front surface 36 (a side in the insertion direction 92) of the main body 35 and on the right side in the width direction (the first direction 94). The door 38 is supported by the shaft 136 to be rotatable relative to the frame 133. The right space in the width direction of the frame 133 with the wall 86 interposed therebetween serves as a storing section 139. The cartridge mounting section 66 (see FIG. 1) is disposed in the storing section 139.

As shown in FIGS. 6 and 8, the frame 133 includes a bottom plate 127 close to the rear surface (a side in the insertion direction 90) of the main body 35. The bottom plate 127 constitutes the bottom surface of the frame 133. The bottom plate 127 is a plate-like member having a longitudinal direction parallel to the first direction 94 and is disposed to connect the lower edge of the wall 86 to the lower edge of the wall 87. As shown in FIG. 8, a recess portion 147 is formed at the center of the bottom plate 127 in the first direction 94. The recess portion 147 is formed downward from the opposed surface 145 (see FIG. 8) facing the sheet feed tray 20 disposed on the bottom plate 127 (see FIG. 9). The cleaning member 130 is disposed in the recess portion 147 (see FIGS. 7 and 9).

The cleaning member 130 is configured to remove paper dust, ink, dust, and the like adhering to the feed roller 25 from the feed roller 25. A material which can be elastically deformed is properly used as the cleaning member 130. The material of the cleaning member 130 can include rubber, brush, felt, and the like and can be properly modified in consideration of the material of the roller surface of the feed roller 25. The recess portion 147 is provided at a position at which the fee roller 25 moving to the bottom plate 127 can contact with the cleaning member 130 in a state where the feed tray 20 is not disposed on the bottom plate 127. The width of the recess portion 147 in the first direction 94 is greater than the axial length (in the first direction 94) of two feed rollers 25. The width of the recess portion 147 in the insertion direction 90 is set so that the roller surface of the feed roller 25 can contact with the cleaning member 130.

The change in posture of the arm 26 accompanied with the drawing of the feed tray 20 from the main body 35 will be described now.

As shown in FIG. 2, the feed roller 25 is disposed at the end of the arm 26. The arm 26 can rotate about the base shaft 28 in directions such that the arm 26 moves to and moves away from the bottom plate 127 of the frame 133 (see FIG. 9). In this embodiment, the feed roller 25 changes its posture relative to the cleaning member 130 between the first posture (see FIGS. 6 and 7) and the second posture (see FIGS. 8 and 9) with the rotation of the arm 26. In the state where the feed roller 25 is maintained in the first posture relative to the cleaning member 130, the feed roller 25 is supported from the downside by the sheet feed tray 20 (see FIG. 6). In the state where the feed roller 25 is maintained in the second posture relative to the cleaning member 130, the feed roller 25 is brought into pressing contact with the cleaning member 130 (see FIG. 8).

The recording operation of an image in the printer unit 11 is performed in a state where the sheet feed tray 20 is inserted into the main body 35. In other words, the recording operation of an image in the printer unit 11 is performed in a state where the sheet feed tray 20 is inserted into the deep side of the main body 35. In still other words, the sheet feed tray 20 is attached to main body 35 when the sheet feed tray 20 is positioned at a first position of the opposed surface 145. The cleaning member 130 is covered with the sheet feed tray 20 when the sheet feed tray 20 is positioned at the first position. By inserting the sheet feed tray 20 into the main body 35, the slope plate 32 is brought into contact with the lower end of the first conveying path 22 (see FIG. 2). In this state, as shown in FIG. 4, the plane 91 of the cam follower 58 contacts with the first inclined surface 111 of the cam 125. Accordingly, the rotation of the cam follower 58 to the sheet feed tray 20 is regulated, and the arm 26 is inclined downward at the same angle as the first inclined surface 111.

The cam follower 58 is urged to the sheet feed tray 20 by means of the weight of the cam follower 58, the arm 26, and the feed roller 25. That is, the roller is urged toward the surface by a gravitational force acting on at least one of the cam follower 50, the arm 26 and the feed roller 25. When the recording sheets are not placed on the sheet feed tray 20, the feed roller 25 contacts with the frictional member 104 (see FIG. 5) of the bottom plate 84. When the recording sheets are placed on the sheet feed tray 20, the feed roller 25 moves upward by the thickness of the recording sheets. Accordingly, the cam follower 58 is separated from the first inclined surface 111. Since the feed roller 25 is supported from the downside by the recording sheets placed on the sheet feed tray 20, the feed roller 25 contacts with the recording sheets placed on the sheet feed tray 20. By rotationally driving the feed roller 25 in this state, the recording sheet on the sheet feed tray 20 is fed to the first conveying path 22. In this way, in the state where the sheet feed tray 20 is inserted into the main body 35, the sheet feed roller 25 is maintained in the first posture (see FIGS. 7 and 8) where it is supported from the downside by the sheet feed tray 20.

The sheet feed tray 20 is drawn in the drawing direction 92 from the state where it is inserted into the main body 35 (i.e., from the first position). Then, the surface of the cam 125 contacting with the plane 91 of the cam follower 58 moves from the first inclined surface 111 to the second inclined surface 112. The second inclined surface 112 of the cam 125 is formed so that the height of the bottom plate 84 (see FIG. 5) increases in the insertion direction 90. Accordingly, the cam follower 58 and the arm 26 rotate upward with the drawing of the sheet feed tray 20 from the main body 35. As a result, the sheet feed roller 25 moves upward with respect to the sheet feed tray 20.

When the sheet feed tray 20 is further drawn out of the main body 35 in the drawing direction 92, the cam follower 58 is supported by the horizontal surface 113. In this state, the cam follower 58 and the arm 26 are maintained in the horizontal posture and the feed roller 25 is disposed higher than the slope plate 32. By further drawing the sheet feed tray 20 in the drawing direction 92, the end 74 of the tray body 102 moves downstream of the arm 26 in the drawing direction 92 and thus the support of the cam follower 58 by the cam 125 is released. The arm 26 rotates toward the bottom plate 127 of the frame 133 by means of the weight of the arm 26, the feed roller 25, and the cam follower 58. In this way, by drawing the sheet feed tray 20 from the main body 35 to a second position in the drawing direction 92, the feed roller 25 changes its posture to the second posture where the feed roller comes in contact with the cleaning member 130 (see FIGS. 8 and 9). Here, the second position is a position where the support of the cam follower 58 by the cam 125 is released with the drawing of the sheet feed tray 20. When the sheet feed tray 20 is positioned at the second position or downstream of the second position in the drawing direction 92, the cleaning member 130 is uncovered by the sheet feed tray 20 such that the feed roller 25 can be cleaned by the cleaning member 130. In this way, since the motion of the sheet feed tray 20 is transmitted to the arm 26 through the cam 125 and the cam follower 58, the arm 26 and the feed roller 25 can change their posture with a simple configuration.

Although FIGS. 8 and 9 shows a state where the sheet feed tray 20 is completely drawn out of the main body 35, the feed roller 25 can change its posture from the first posture to the second posture without completely drawing the sheet feed tray 20 out of the main body 35. That is, the feed roller 25 changes its posture from the first posture to the second posture by drawing the sheet feed tray 20 with respect to the main body 35 to the second position where the support of the cam follower 58 by the cam 125 is released. The second position may be a position of the sheet feed tray 20 having been completely drawn out of the space 135 of the main body 35.

In recording an image, the sheet feed tray 20 with recording sheets placed thereon is inserted into the main body 35 and positioned at the first position. Accordingly, the feed roller 25 becomes the first posture where the feed roller 25 is supported from the downside by the sheet feed tray 20 and the feed roller 25 contacts with the recording sheet on the sheet feed tray 20. When a print command is given on the basis of a user's predetermined operation from the operation panel 14, the feed roller 25 is rotationally driven. Accordingly, the recording sheet on the sheet feed tray 20 is fed to the first conveying path 22 in the direction indicated by the arrow 17 (see FIG. 2). An image is recorded on one surface (recording surface 64) of the recording sheet by the recording section 24 in the course of conveying the recording sheet through the first conveying path 22.

When a print mode is set to the one-sided recording operation, the switch-back roller 53 rotates forward in a state where the frame 55 is maintained in the horizontal posture (see FIG. 3). Accordingly, the recording sheet 65 (see FIG. 3) with an image recorded on the recording surface 64 is discharged from the first conveying path 22 to the sheet discharge tray 21.

When the print mode is set to the double-sided recording operation, the switch-back roller 53 rotates forward in a state where the frame 55 is maintained in the horizontal posture. Accordingly, the recording sheet 65 with an image recorded on the recording surface 64 as described above is sent toward the sheet discharge tray 21 (to the right side in FIG. 3). Then, when the rear end 62 of the recording sheet 65 reaches to a predetermined position on the more upstream side than the spurs 56 (the state shown in FIG. 3), the frame 55 changes its posture from the horizontal posture and the rotation posture. With this change in posture, the rear end 62 of the recording sheet 65 is pressed downward by the spurs 56 and is sent to the second conveying path 23.

The switch-back roller 53 rotates backward in the state where the frame 55 is maintained in the rotation posture. Then, the recording sheet 65 changes its conveying direction, is conveyed through the second conveying path 23 in the switch-back manner, and is sent to the sheet feed tray 20. Specifically, the recording sheet 65 is sent between the uppermost recording sheet placed on the sheet feed tray 20 and the feed roller 25 (hereinafter, referred to as "contact position"). When the rear end 62 of the recording sheet 65 reaches the contact position, the feed roller 25 is rotationally driven and the recording sheet 65 is sent to the upstream side (upstream portion 46) of the recording section 24. The recording sheet 65 is turned over in the conveyance course. That is, when the recording sheet 65 is conveyed onto the platen 42, the opposite surface of the recording surface 64 faces the ink jet recording head 41. When the recording sheet 65 passes through the platen 42, an image is recorded on the other surface (the opposite surface of the recording surface 64). When the recording sheet 65 is sent from the second conveying path 23 to the first conveying path 22, the arm 55 changes its posture from the rotation posture to the horizontal posture. The recording sheet 65 with images recorded on both surfaces thereof is discharged to the sheet discharge tray 21 from the first conveying path 22 by the switch-back roller 53 which rotates forward.

In the printer unit 11, the feed roller 25 is rotationally driven in the state where the feed roller contacts with the recording sheet placed on the sheet feed tray 20. Accordingly, the paper dust or dust on the recording sheet may be attached to the feed roller 25. When the double-sided recording operation is performed by the printer unit 11, the feed roller 25 is rotationally driven in the state where the feed roller 25 contacts with the recording surface 64 (see FIG. 3) of the recording sheet 65. Ink ejected from the ink jet recording head 41 (see FIG. 2) is attached to the recording surface 64. When the recording sheet 65 is sent from the second conveying path 23 to the sheet feed tray 20 in a state where the ink attached to the recording surface 64 is not sufficiently dried, the ink of the recording sheet 65 may adhere to the feed roller 25. In this way, paper dust, dust, and ink may adhere to the feed roller 25. As a result, a feed failure may occur in feeding a recording sheet from the sheet feed tray 20 to the first conveying path 22.

An operation of cleaning the feed roller 25 is performed as follows.

The sheet feed tray 20 is supported from the downside by the bottom plate 127 of the frame 133 in the state where the sheet feed tray 20 is inserted into the main body 35 (see FIGS. 6 and 7). Accordingly, the feed roller 25 is maintained in the first posture where it is supported from the downside by the sheet feed tray 20. When the recording sheet is not correctly conveyed from the sheet feed tray 20 to the first conveying path 22, the sheet feed tray 20 is drawn out to a predetermined position from the main body 35 by the user. For example, the sheet feed tray 20 is drawn out of the main body 35 using a mark recorded on the sheet feed tray 20 as a reference. Then, the motion of the sheet feed tray 20 is transmitted to the arm 26 through the cam 125 and the cam follower 58 and the feed roller 25 moves upward above the sheet feed tray 20. When the sheet feed tray 20 is further drawn out relative to the main body 35, the support of the cam follower 58 by the cam 125 is released. Accordingly, the feed roller 25 can changes its posture from the first posture (see FIGS. 6 and 7) to the second posture (see FIGS. 8 and 9) relative to the cleaning member 130. That is, the feed roller 25 having come in pressing contact with the recording sheet on the sheet feed tray 20 once moves upward and then contacts with the cleaning member 130 of the bottom plate 127. Accordingly, the feed roller 25 can be cleaned. By rotationally driving the feed roller 25 in this state, the feed roller 25 is cleaned by the cleaning member 130. Here, the cleaning is an operation of rotationally driving the feed roller 25 in a state where the cleaning member 130 is brought into contact with the feed roller 25. Accordingly, the paper dust, ink, and dust attached to the feed roller 25 is removed from the feed roller 25.

As described above, the feed roller 25 can be cleaned by means of a simple operation, e.g., by simply drawing out the sheet feed tray 20 from the main body 35 to the predetermined position. Accordingly, it is possible to clean the feed roller 25 with a simple structure without allowing a user to perform a troublesome operation of installing the cleaning member or separating and retaining the cleaning member. Since the cleaning member 130 is disposed on the bottom plate 127 located below the sheet feed tray 20, the recording sheets on the sheet feed tray 20 are prevented from the contamination due to the cleaning member 130.

In the printer unit 11, the feed roller 25 is brought into pressing contact with the cleaning member 130 by drawing out the sheet feed tray 20 from the main body 35 to the predetermined position in the drawing direction 92. The predetermined position is a position where the cam follower 58 is separated from the cam 125. Accordingly, it is possible to clean the feed roller 25 without completely drawing out the sheet feed tray 20 from the main body 35. That is, the feed roller 25 is cleaned in the state where a part of the sheet feed tray 20 is disposed in the space 135 of the main body 35. Accordingly, since a user's hand does not contact with the feed roller 25 during the cleaning of the feed roller 25, it is possible to safely clean the feed roller 25.

The feed roller 25 changes its posture from the first posture to the second posture without taking out the recording sheets from the sheet feed tray 20. Accordingly, it is possible to clean the feed roller 25 during the recording operation in the printer unit 11.

In this embodiment, the cleaning member 130 is formed of rubber which can be elastically deformed. Accordingly, when the feed roller 25 is brought into pressing contact with the cleaning member 130, the cleaning member 130 is brought into close contact with the feed roller 25. Therefore, it is possible to enhance the cleaning effect, compared with a case where the cleaning member 130 cannot be elastically deformed. However, the cleaning member 130 may be formed of a material which cannot be elastically deformed. In this case, the roller surface of the feed roller 25 may be formed of an elastically deformable material, which can absorb the damage of the feed roller 25 due to the cleaning operation.

In this embodiment, it has been described that the image recording apparatus is of a double-sided recording type which can record images on both surfaces of the recording sheet 65. The image recording apparatus according to the embodiment is not limited to the double-sided recording apparatus. That is, the image recording apparatus according to the embodiment may be a one-sided recording apparatus which can record an image on only one surface of the recording sheet 65. However, when the image recording apparatus according to the embodiment is applied to the double-sided recording apparatus, the ink attached to the feed roller 25 can be removed from the feed roller 25.

In this embodiment, the cleaning member 130 is disposed in the recess portion 147. Accordingly, when the feed roller 25 is rotational driven in the state where the feed roller is maintained in the second posture (see FIGS. 8 and 9), it is possible to prevent the cleaning member 130 from moving in the rotation direction of the feed roller 25. As shown in FIG. 9, by providing the cleaning member 130 in the recess portion 147 so as not to protrude from the top surface of the opposed surface 145, it is possible to prevent paper dust, ink, dust, and the like removed from the feed roller 25 by the cleaning member 130 from adhering to the sheet feed tray 20 or the frame 133.

As long as the feed roller can move in the directions toward and away from the bottom plate 127 of the frame 133, the feed roller 25 need not be supported by the arm 26. For example, the feed roller 25 may be rotatably supported by a shaft that is slidable in the vertical direction.

Another Embodiment

Figure 10A:
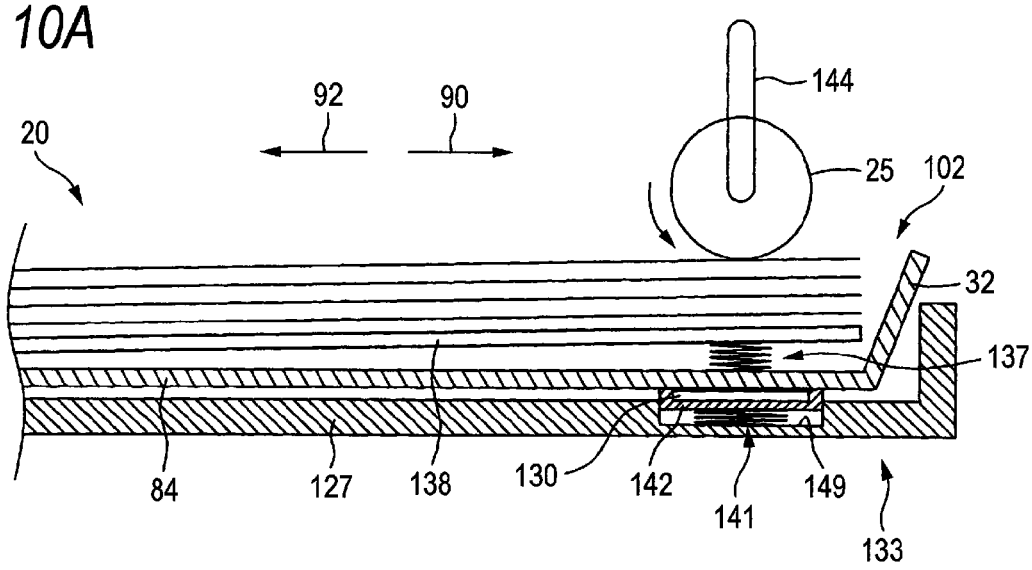
FIGS. 10A and 10B are diagrams schematically explaining a state where a cleaning member moves to the feed roller with the drawing of the sheet feed tray.
Figure 10B:
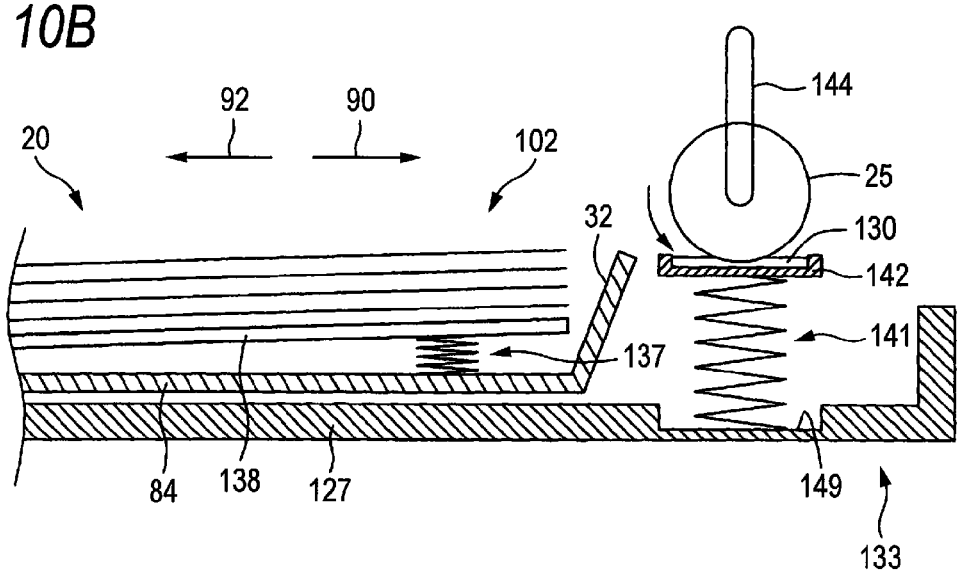

FIGS. 10A and 10B are diagrams schematically explaining a state where the cleaning member 130 is moving to the feed roller 25 with the drawing of the sheet feed tray 20.

The cleaning member 130 may be elastically urged to the feed roller 25 so that the feed roller 25 changes its posture from the first posture to the second posture. In a modified example of the embodiment, the feed roller 25 is rotatably supported by a shaft 144 fixed to the main body 35 (see FIGS. 10A and 10B). Here, a plate 138 is disposed on the bottom plate 84 of the tray body 102 with a coil spring 137 interposed therebetween. The downstream portion of the plate 138 in the insertion direction 90 is elastically urged upward by the coil spring 137 (see FIG. 10A). The recording sheet is placed on the plate 138 and is placed on the sheet feed tray 20.

As shown in FIGS. 10A and 10B, a storing portion 149 is formed at the bottom plate 127 below the feed roller 25. A support member 142 is disposed at the storing portion 149, for example, with an urging member such as a coil spring 141 interposed therebetween. The cleaning member 130 is disposed on the support member 142. Accordingly, the cleaning member 130 is elastically urged to the feed roller 25 relative to the bottom plate 127.

When the sheet feed tray 20 is inserted into the main body 35 in the insertion direction 90, the bottom plate 84 of the tray body 102 rides on the support member 142. Accordingly, the support member 142 is pushed down by the bottom plate 84 of the sheet feed tray 20 (see FIG. 10A). Then, the coil spring 141 is compressed and the coil spring 141 thus accumulates the spring force for pushing up the support member 142 to the feed roller 25. Since the plate 138 is elastically urged upward, the recording sheets on the sheet feed tray 20 is brought into pressing contact with the feed roller 25. Accordingly, the feed roller 25 is maintained in the first posture where it is supported from the downside by the sheet feed tray 20 (see FIG. 10A).

The sheet feed tray 20 is drawn out from the main body 35 to a second position in the drawing direction 92 (see FIGS. 10A and 10B). Accordingly, the pressing force on the cleaning member 130 from the bottom plate 84 disappears and the support member 142 moves to the feed roller 25 with the spring force accumulated by the coil spring 141. As a result, the feed roller 25 is brought into contact with the cleaning member 130 disposed in the support member 142 (see FIG. 10B). By rotationally driving the feed roller 25 in this state, the feed roller 25 is cleaned by the cleaning member 130.

According to the embodiments of the invention, there is provided: an image recording apparatus according to an aspect of the invention includes: a main body; a first tray attachable to and capable of being drawn out of the main body, the first tray allowing a sheet to be placed thereon; a first conveying path through which the sheet fed from the first tray is conveyed; a roller that is brought into pressing contact with the sheet placed on the first tray and configured to feed the sheet to the first conveying path; a recording unit configured to record an image on the sheet in a course of conveying the sheet; a frame configured to support the first tray from a downside; and a cleaning member disposed at the frame to clean the roller. Here, the roller is changeable its posture relative to the cleaning member between a first posture in which the roller is supported from the downside by the first tray in a state where the first tray is inserted into the main body and a second posture in which the roller is brought into pressing contact with the cleaning member by drawing out the first tray from the main body to a predetermined position.

A sheet is allowed to be placed on the first tray. The first tray can be drawn from the main body. A printing start is instructed in a state where the first tray is inserted into the main body. Then, the roller press-contacting with the sheet on the first tray is rotationally driven and the sheet is fed from the first tray to the first conveying path. An image is recorded on the sheet by a recording section in the course of conveying the sheet through the first conveying path. The image is recorded by attaching ink or toner to the sheet.

The first tray is supported from the downside by the frame disposed in the main body. The cleaning member is disposed at the frame. In the image recording apparatus, the roller is cleaned by the cleaning member. The cleaning is performed by rotationally driving the roller in a state where the cleaning member is brought into contact with the roller. By this operation, paper dust, ink, toner, dust, and the like adhering to the roller are removed from the roller. The cleaning member used in this operation may be made of rubber, brush, or felt.

The roller can change its posture relative to the cleaning member between the first posture and the second posture. That is, the roller moves relative to the cleaning member disposed at a predetermined position, or the cleaning member moves relative to the roller disposed at a predetermined position. Accordingly, the roller changes its posture relative to the cleaning member between the first posture and the second posture. When the first tray is inserted into the main body, the change in posture from the first posture to the second posture is regulated and the roller is thus kept in the first posture. In the first posture, the roller is supported from the downside by the first tray. That is, in the first posture, the first tray is interposed between the roller and the cleaning member and thus the roller is separated from the cleaning member. By drawing out the first tray from the main body to a predetermined position, the regulation by the first tray is released and the roller changes its posture from the first posture to the second posture. An example of the predetermined position is a position where the first tray is not drawn out completely from the main body. In the second posture, the roller moves in the direction in which it gets close to the cleaning member, and brought into pressing contact with the cleaning member. This change in posture may be executed, for example, by allowing the cleaning member to move toward the roller rotatably attached to the main body.

As described above, the roller can be cleaned by simply drawing out the first tray from the main body to the predetermined position. Accordingly, it is possible to clean the roller with a simple configuration without allowing a user to perform troublesome operations of installing the cleaning member or separating and retaining the cleaning member. Since the cleaning member is disposed in the frame located below the first tray, it is possible to prevent the sheets on the first tray from being contaminated by the cleaning member. At the time of cleaning the roller, it is not necessary to perform operations of taking out the sheets from the tray or returning the taken-out sheets to the tray.

The image recording apparatus may further include an arm that can rotate or pivot about a predetermined axis in a direction toward and away from the frame. Here, the roller may be rotatably disposed at an end of the arm.

The roller is rotatably disposed at an end of the arm. The arm can pivot or rotate about a predetermined pivot in the direction such that the arm moves to and moves away from the frame. The first tray is inserted into the main body. Then, the arm is made to rotate by the first tray, the roller is separated from the cleaning member, and the roller is brought into pressing contact with the sheet on the first tray. That is, the sheet can be fed from the first tray to the first conveying path. The first tray is drawn out of the main body to a predetermined position. Accordingly, the arm moves to the frame, for example, by the weight of the arm and the roller. As a result, the roller is brought into pressing contact with the cleaning member and thus the roller can be cleaned.

The image recording apparatus may further include: a cam formed in at least one side wall of the first tray facing a first horizontal direction substantially perpendicular to a drawing direction of the first tray; and a cam follower that extends along the first direction from the arm and configured to transmit a motion of the cam accompanied with the movement of the first tray to the arm.

The motion of the cam accompanied with the movement of the first tray is transmitted to the arm through the cam follower. As a result, the roller disposed at the end portion of the arm changes its posture relative to the cleaning member between the first posture and the second posture. According to the above-mentioned configuration, the roller can change its posture with a simple structure.

The frame may have a recess portion at a surface facing the first tray, and the cleaning member may be disposed in the recess portion.

The cleaning member is disposed in the recess portion formed at the frame. Accordingly, it is possible to prevent paper dust, ink, toner, dust, and the like removed from the roller by the cleaning member from being adhering to the first tray or the frame.

The cleaning member may be elastically urged toward the roller so that the roller relatively changes its posture from the first posture to the second posture.

The cleaning member is elastically urged toward the roller, for example, by a coil spring. When the first tray is inserted into the main body, the cleaning member is pushed down by the first tray. Accordingly, the coil spring is compressed and thus the coil spring accumulates a spring force for pushing up the cleaning member toward the roller. When the first tray is drawn out from the main body to a predetermined position, the pressing force from the first tray to the cleaning member disappears and the cleaning member moves toward the roller with the spring force accumulated in the coil spring. As a result, the roller is brought into pressing contact with the cleaning member.

The cleaning member may be elastically deformable.

According to this configuration, when the roller changes its posture from the first posture to the second posture, the cleaning member is brought into close contact with the roller, thereby enhancing the cleaning effect.

The image recording apparatus may further include: a second conveying path that connects the first conveying path and the first tray and through which the sheet conveyed through the first conveying path is conveyed in a switch-back manner; a second tray to which the sheet conveyed through the first conveying path is discharged; and a path switching section configured to select one of the second tray and the second conveying path, to which the sheet conveyed through the first conveying path is sent.

An image is recorded on one surface of the sheet fed to the first conveying path by the recording section in the course of conveying the sheet. When a one-sided recording operation is set, the sheet is discharged to the second tray by the path switching section. When a double-sided recording operation is set, the sheet is sent to the second conveying path by the path switching section. The sheet is switched back and conveyed through the second conveying path and is fed to the first tray. The sheet is sent to the first conveying path again by rotationally driving the roller in the first posture. The sheet is turned over in the course of conveying the sheet and an image is recorded on the other surface by the recording section. In this way, the images are recorded on both sides of the sheet and the sheet is discharged from the first conveying path to the second tray by the path switching section.

When the sheet in which an image is recorded on one surface thereof is sent to the first conveying path again, the roller is brought into pressing contact with the recording surface of the sheet. The recording surface is a surface of the sheet to which ink or toner is attached by the recording section. When the sheet is sent to the first conveying path again in a state where the ink or toner is not sufficiently dried, the ink or toner on the sheet may adhere to the roller. However, by changing the posture of the roller from the first posture to the second posture and rotationally driving the roller, the roller is cleaned and the ink or toner adhering to the roller is removed from the roller.

According to the embodiments of the invention, the roller can be cleaned by drawing out the first tray from the main body to the predetermined position. Accordingly, it is possible to clean the roller with a simple configuration without troublesome operations of installing the cleaning member or separating and retaining the cleaning member. Since the cleaning member is disposed at the frame located below the first tray, it is possible to prevent the sheets on the first tray from being contaminated by the cleaning member. At the time of cleaning the roller, it is not necessary to perform operations of taking out the sheets from the tray or returning the taken-out sheets to the tray.

What is claimed is:

1. An image recording apparatus comprising:

a main body;

a first tray attachable to and capable of being drawn out of the main body, the first tray allowing a sheet to be placed thereon;

a first conveying path through which the sheet fed from the first tray is conveyed;

a roller that is brought into pressing contact with the sheet placed on the first tray and configured to feed the sheet to the first conveying path;

a recording unit configured to record an image on the sheet in a course of conveying the sheet;

a frame configured to support the first tray from a downside;

a cleaning member disposed at the frame and configured to clean the roller, and an arm pivotable about a pivotal center in a direction toward or away from the frame, wherein the roller is rotatably disposed at an end portion of the arm, wherein the roller is movable relative to the cleaning member, the roller being movable between a first posture in which the roller is supported from the downside by the first tray in a state where the first tray is inserted into the main body and a second posture in which the roller is brought into pressing contact with the cleaning member by drawing out the first tray from the main body to a predetermined position, wherein the first tray comprises side walls facing one another and in a first direction that is substantially horizontal and substantially perpendicular to a drawing direction of the first tray, and wherein the image recording apparatus further comprises:

a cam formed on at least one of the side walls of the first tray; and a cam follower that extends along the first direction from the arm and is configured to transmit a motion of the cam accompanied with the movement of the first tray to the arm.

2. The image recording apparatus according to claim 1, wherein the frame has a recess portion at a surface facing the first tray, and wherein the cleaning member is disposed in the recess portion.

3. The image recording apparatus according to claim 1, wherein the cleaning member is elastically urged toward the roller so that the roller relatively changes its posture from the first posture to the second posture.

4. The image recording apparatus according to claim 3, wherein the cleaning member is movable relative to a surface of the frame which faces the first tray.

5. The image recording apparatus according to claim 1, wherein the cleaning member is elastically deformable.

6. The image recording apparatus according to claim 1, further comprising:

a second conveying path that connects the first conveying path and the first tray and through which the sheet conveyed through the first conveying path is switched back and conveyed;

a second tray to which the sheet conveyed through the first conveying path is discharged; and a path switching section configured to select one of the second tray and the second conveying path, to which the sheet conveyed through the first conveying path is sent.

7. The image recording apparatus according to claim 1, wherein the roller is urged in a direction toward the frame.

8. The image recording apparatus according to claim 7, wherein the frame having a surface facing to and disposed below the roller, wherein the roller is urged toward the surface by a gravitational force acting on the roller.

9. A medium feeding device capable of feeding a recording medium placed on a first tray, the medium feeding device comprising:

a frame having a first surface and allowing the first tray to be movable along the first surface, the first tray being attached to the medium feeding device at a first position of the first surface;

a feeding member configured to feed the recording medium to a first conveying path when the first tray with the recording medium thereon is positioned at the first position;

a roller configured to be brought into pressing contact with the sheet placed on the first tray and configured to feed the sheet to the first conveying path;

a cleaning member disposed at the first surface of the frame and configured to clean the feeding member when the cleaning member is uncovered by the first tray; and an arm pivotable about a pivotal center in a direction toward or away from the frame, wherein the roller is rotatably disposed at an end portion of the arm, wherein the first tray comprises side walls facing one another and in a first direction that is substantially horizontal and substantially perpendicular to a drawing direction of the first tray, wherein the image recording apparatus further comprises:

a cam formed on at least one of the side walls of the first tray; and a cam follower that extends along the first direction from the arm and is configured to transmit a motion of the cam accompanied with the movement of the first tray to the arm.

10. The medium feeding device according to claim 9, wherein the feeding member is movable relative to the cleaning member.

11. The medium feeding device according to claim 9, wherein the cleaning member contacts with the feeding member when the cleaning member is uncovered.

12. The medium feeding device according to claim 9, wherein the feeding member includes a roller rotatable about an axis extending along the first surface.

* * * * *